US011661871B2

(12) United States Patent
Yang

(10) Patent No.: US 11,661,871 B2
(45) Date of Patent: May 30, 2023

(54) MUFFLER FOR VEHICLE

(71) Applicants: HYUNDAI MOTOR COMPANY, Seoul (KR); KIA MOTORS CORPORATION, Seoul (KR)

(72) Inventor: Young Dug Yang, Seoul (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 194 days.

(21) Appl. No.: 16/925,686

(22) Filed: Jul. 10, 2020

(65) Prior Publication Data

US 2021/0140354 A1 May 13, 2021

(30) Foreign Application Priority Data

Nov. 11, 2019 (KR) ..... 10-2019-0143687

(51) Int. Cl.

| | |
|---|---|
| ***F01N 1/16*** | (2006.01) |
| ***F01N 1/18*** | (2006.01) |
| ***F01N 1/08*** | (2006.01) |
| ***F16K 3/02*** | (2006.01) |
| *F01N 1/00* | (2006.01) |
| *F16K 3/00* | (2006.01) |

(52) U.S. Cl.

CPC ..... *F01N 1/083* (2013.01); *F01N 1/085* (2013.01); *F01N 1/165* (2013.01); *F01N 1/18* (2013.01); *F01N 2390/08* (2013.01); *F01N 2490/04* (2013.01); *F01N 2490/08* (2013.01)

(58) Field of Classification Search

CPC ..... F01N 1/083; F01N 1/085; F01N 1/165; F01N 1/18; F01N 1/089; F01N 1/163; F01N 1/166; F01N 1/168; F01N 1/16; F01N 1/161; F01N 2390/08; F01N 2390/06; F01N 2490/04; F01N 2490/08; F16K 3/00; F16K 3/02; F16K 3/0281

See application file for complete search history.

(56) References Cited

U.S. PATENT DOCUMENTS 895,697 A * 8/1908 Snow ..... F01N 1/166 181/254
2,072,372 A * 3/1937 Riethmiller ..... F01N 1/166 181/254

(Continued)

FOREIGN PATENT DOCUMENTS

CN 110107704 A * 8/2019 ..... F16K 3/0281
JP H08291723 A * 11/1996

(Continued)

*Primary Examiner* — Edgardo San Martin
(74) *Attorney, Agent, or Firm* — Lempia Summerfield Katz LLC

(57) ABSTRACT

A muffler for a vehicle includes: a muffler shell; a baffle disposed within the muffler shell, and having a first opening and a second opening which allow an exhaust gas to pass therethrough; and a variable valve mounted on the baffle. In particular, the variable valve includes: a valve plate rotatably mounted to open and close the first opening of the baffle; a valve arm connected to the valve plate; and a valve actuator to move the valve arm by variations in pressure of the exhaust gas. The valve plate is capable of rotating in a plane parallel to a plane of the baffle.

7 Claims, 6 Drawing Sheets

(56) References Cited

U.S. PATENT DOCUMENTS

| | | | | | |
|---|---|---|---|---|---|
| 4,484,659 | A * | 11/1984 | Buchwalder | F01N 1/02 | 181/266 |
| 4,492,519 | A * | 1/1985 | Owen | F02B 37/186 | 251/300 |
| 5,614,699 | A * | 3/1997 | Yashiro | F01N 1/166 | 181/254 |
| 5,744,762 | A * | 4/1998 | Seki | F01N 1/166 | 181/254 |
| 6,499,562 | B1 * | 12/2002 | Elfinger | F01N 1/166 | 181/254 |
| 6,637,545 | B1 * | 10/2003 | Jonsson | F01N 1/165 | 181/254 |
| 8,201,660 | B2 * | 6/2012 | Han | F01N 1/163 | 181/254 |
| 2006/0027420 | A1 * | 2/2006 | Hahnl | F01N 3/04 | 181/283 |
| 2010/0314570 | A1 * | 12/2010 | Ellis | F16K 3/06 | 251/301 |

FOREIGN PATENT DOCUMENTS

| | | | | | |
|---|---|---|---|---|---|
| JP | H0941939 | A * | 2/1997 | | |
| KR | 20050027615 | A * | 3/2005 | | |
| KR | 20060115078 | A * | 11/2006 | | |
| KR | 20220010315 | A * | 1/2022 | | |
| WO | WO-2017078483 | A1 * | 5/2017 | | B01D 17/02 |

* cited by examiner

MUFFLER FOR VEHICLE

CROSS-REFERENCE TO RELATED APPLICATION

This application claims priority to and the benefit of Korean Patent Application No. 10-2019-0143687, filed on Nov. 11, 2019, the entire contents of which are incorporated herein by reference.

FIELD

The present disclosure relates to a muffler for a vehicle.

BACKGROUND

The statements in this section merely provide background information related to the present disclosure and may not constitute prior art.

A muffler for a vehicle receives exhaust gases discharged from an internal combustion engine or a diesel engine for the purpose of reducing noise produced by the exhaust gas flow. In general, the muffler includes a muffler shell, a plurality of baffles disposed within the muffler shell, and a plurality of pipes mounted between adjacent baffles. The interior space of the muffler shell may be divided into a plurality of chambers by the plurality of baffles, and the plurality of pipes may pass through adjacent baffles to connect between adjacent chambers. A plurality of micro holes may be formed in a wall of each pipe to attenuate sound waves and reduce noise level.

In order to reduce the exhaust noise, a variable valve may be mounted on any one of the plurality of baffles. The variable valve includes a valve body having an opening through which the exhaust gas passes, a valve plate pivotally mounted on the valve body to open and close the opening of the valve body, and a torsion spring elastically supporting the valve plate. When the pressure of the exhaust gas is greater than a spring force of the torsion spring, the valve plate may be spaced apart from the valve body. When the pressure of the exhaust gas is less than the spring force of the torsion spring, the valve plate may be brought into contact with the valve body by the elastic force of the torsion spring. When the pressure of the exhaust gas is less than the spring force of the torsion spring (when the pressure of the exhaust gas is relatively low), the torsion spring may serve as a biasing element applying the spring force (biasing force) to bias the valve plate toward a closed position.

In a variable valve according to the related art, as the pressure of the exhaust gas varies, the valve plate is spaced apart from or is brought into contact with the valve body to open and close the opening of the valve body. Accordingly, the valve plate moves in the same direction as a direction of the exhaust gas flow. When the valve plate opens and closes the opening of the valve body, noise due to shaking or vibrations of the valve plate itself and noise due to a contact or impact between the valve plate and the valve body may be produced. In order to prevent such noises, a shock absorbing material such as a metal mesh may be interposed between the valve plate and the valve body. However, the assembly of an additional component such as the shock absorbing material increases manufacturing cost and weight.

By considering corrosion resistance, oxidation resistance, etc. for the torsion spring, which is a biasing element used in the related art variable valve, an expensive material such as INCONEL is applied. The torsion spring has a larger size than a coil spring, and the manufacturing thereof is relatively difficult, and thus the manufacturing cost and weight are relatively increased.

The above information described in this background section is provided to assist in understanding the background of the inventive concept, and may include any technical concept which is not considered as the prior art that is already known to those skilled in the art.

SUMMARY

The present disclosure has been made to solve the above-mentioned problems occurring in the prior art while advantages achieved by the prior art are maintained intact.

An aspect of the present disclosure provides a muffler for a vehicle, capable of minimizing or preventing various noises produced by the opening and closing of a variable valve.

According to an aspect of the present disclosure, a muffler for a vehicle may include: a muffler shell; a baffle disposed within the muffler shell, and having a first opening and a second opening, which allow an exhaust gas to pass therethrough; and a variable valve mounted on the baffle. In particular, the variable valve may include: a valve plate rotatably mounted to open and close the first opening of the baffle; a valve aim connected to the valve plate; and a valve actuator configured to move the valve arm by variations in pressure of the exhaust gas. The valve plate may be capable of rotating in a plane parallel to a plane of the baffle.

In one form, the valve plate may be rotatably mounted on the baffle through a shaft to maintain a contact with a surface of the baffle.

In another form, the valve actuator may include: an actuator housing having a receiving space which receives the exhaust gas through the second opening, and the receiving space of the actuator housing may directly communicate with the second opening of the baffle.

In other form, the valve plate may have a lug extending from an outer peripheral edge thereof, and the lug may be rotatably mounted on the baffle through the shaft.

In some forms of the present disclosure, the valve arm may be moved by the pressure of the exhaust gas received in the receiving space of the actuator housing. The lug may have a guide projection protruding in a direction away from the baffle, and the valve arm may have a guide recess by which a movement of the guide projection is guided. As the valve arm moves, the guide projection of the lug may be guided along the guide recess of the valve arm so that the valve plate may rotate.

In some forms of the present disclosure, the actuator housing may have a guide opening by which a movement of the valve arm is guided, and edges of the actuator housing may be coupled to the baffle by welding all around.

In some forms of the present disclosure, the valve arm may include a disc located within the receiving space of the actuator housing, and the disc may have a contact surface with which the exhaust gas received in the receiving space of the actuator housing directly comes into contact.

In one form, the disc may have a shape and a size conforming to the receiving space of the actuator housing.

The contact surface of the disc may be perpendicular to a longitudinal axis of the valve arm.

The valve actuator may include a spring interposed between an inner surface of the actuator housing and the disc.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
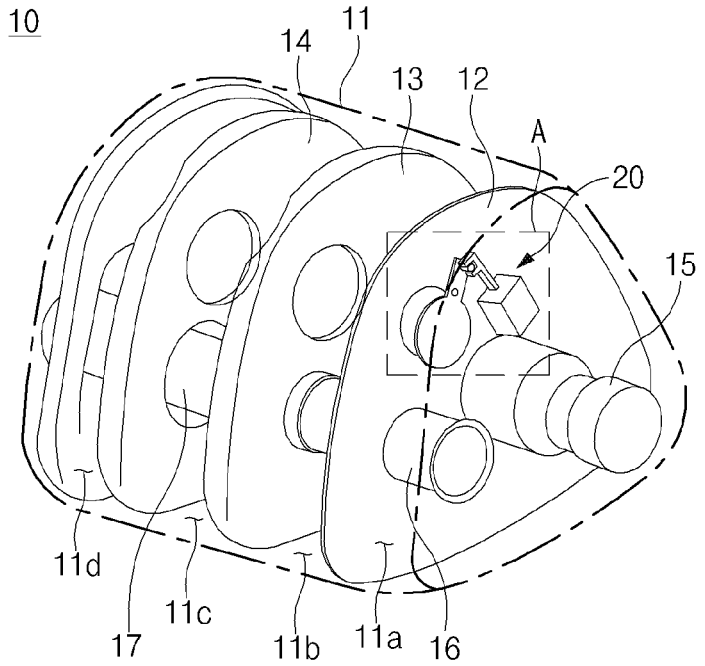
FIG. 1 illustrates a perspective view of a muffler for a vehicle according to an exemplary form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Hereinafter, exemplary forms of the present disclosure will be described in detail with reference to the accompanying drawings. In addition, a detailed description of well-known techniques associated with the present disclosure will be ruled out in order not to unnecessarily obscure the gist of the present disclosure.

Terms such as first, second, A, B, (a), and (b) may be used to describe the elements in exemplary forms of the present disclosure. These terms are only used to distinguish one element from another element, and the intrinsic features, sequence or order, and the like of the corresponding elements are not limited by the terms. Unless otherwise defined, all terms used herein, including technical or scientific terms, have the same meanings as those generally understood by those with ordinary knowledge in the field of art to which the present disclosure belongs. Such terms as those defined in a generally used dictionary are to be interpreted as having meanings equal to the contextual meanings in the relevant field of art, and are not to be interpreted as having ideal or excessively formal meanings unless clearly defined as having such in the present application.

Referring to FIG. 1, a muffler 10 for a vehicle, according to an exemplary form of the present disclosure, may include: a muffler shell 11, a plurality of baffles 12, 13, and 14 disposed within the muffler shell 11, and a plurality of pipes 15, 16, and 17 mounted between adjacent baffles 12, 13, and 14.

The interior space of the muffler shell 11 may be divided into a plurality of chambers 11*a*, 11*b*, 11*c*, and 11*d* by the plurality of baffles 12, 13, and 14, and the plurality of pipes 15, 16, and 17 may pass through adjacent baffles to connect between adjacent chambers. A plurality of micro holes may be formed in a wall of each pipe, thereby attenuating sound waves and reducing noise level.

The muffler 10 for a vehicle, may include a variable valve 20 mounted on at least one baffle 12 of the plurality of baffles 12, 13, and 14. The baffle 12 may have a first opening 31 and a second opening 32 that allow an exhaust gas to pass therethrough. The first opening 31 may be opened and closed by the variable valve 20 depending on variations in pressure of the exhaust gas.

Figure 2:
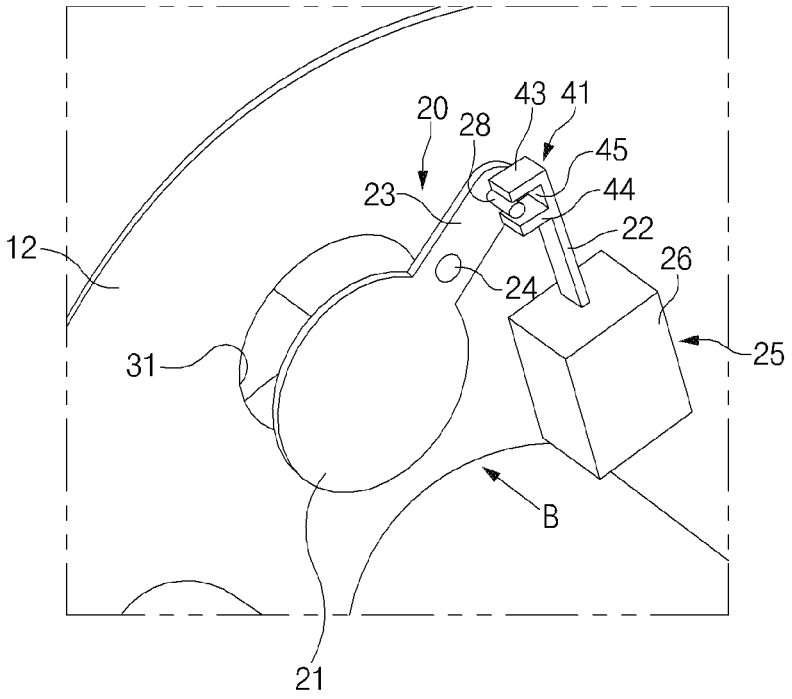
FIG. 2 illustrates an enlarged view of portion A of FIG. 1.

Referring to FIG. 2, the variable valve 20 may include a valve plate 21 opening and closing the first opening 31 of the baffle 12, a valve arm 22 connected to the valve plate 21, and a valve actuator 25 moving the valve arm 22 linearly by the variations in the pressure of the exhaust gas.

The valve plate 21 may be rotatably mounted to be adjacent to the first opening 31 of the baffle 12 through a shaft 24. A diameter of the valve plate 21 may be greater than a diameter of the first opening 31, and an axis of the shaft 24 may be perpendicular to the baffle 12. As the valve plate 21 rotates around the shaft 24, the valve plate 21 may open and close the first opening 31. Specifically, the valve plate 21 may rotate in a first rotation direction R1 or a second rotation direction R2. The first rotation direction R1 refers to a rotation direction in which the valve plate 21 opens the first opening 31, and the second rotation direction R2 refers to a rotation direction in which the valve plate 21 closes the first opening 31.

In particular, the valve plate 21 may be mounted on the baffle 12 by the shaft 24 to slidably rotate on a surface of the baffle 12. Specifically, the valve plate 21 may be rotatably mounted to the baffle 12 by the shaft 24 so that the valve plate 21 may maintain a contact with the baffle 12 when the valve plate 21 rotates (that is, the first opening 31 of the baffle 12 is opened and closed). In particular, the valve plate 21 may be capable of rotating in a plane parallel to a plane of the baffle 12. Thus, even when the valve plate 21 is slightly spaced apart from the baffle 12, shaking or vibrations of the valve plate itself may be prevented.

The valve plate 21 may have a lug 23 radially extending outwards from an outer peripheral edge thereof, and the lug 23 may be rotatably mounted on the baffle 12 through the shaft 24. A guide projection 28 may protrude from a free end of the lug 23 in a direction away from the baffle 12. An axis of the guide projection 28 may be perpendicular to a longitudinal axis of the lug 23. For example, the axis of the guide projection 28 may be parallel to the axis of the shaft 24.

The valve arm 22 may have a shape of a bar having a predetermined length. The valve arm 22 may have a first end portion connected to the valve plate 21, and a second end portion 42 connected to the valve actuator 25. The valve arm 22 may be linearly moved by the valve actuator 25. Specifically, the valve arm 22 may move in a first direction F1 or a second direction F2. The first direction F1 refers to a direction in which the first end portion 41 of the valve arm 22 is away from the valve actuator 25, and the second direction F2 refers to a direction in which the first end portion 41 of the valve arm 22 is close to the valve actuator 25.

The valve arm 22 may have a guide recess 45 by which a movement of the guide projection 28 of the valve plate 21 is guided.

For example, as illustrated in FIGS. 2 to 4, and 6, the valve arm 22 may have two fingers 43 and 44 extending from the first end portion 41 toward the valve plate 21, and the guide recess 45 defined by the fingers 43 and 44. As the guide recess 45 is defined by the two fingers 43 and 44, it may be a slot of which one end is open (that is, an end open slot). As the two fingers 43 and 44 are spaced apart from each other in a longitudinal direction of the valve arm 22, the guide recess 45 may be defined by the fingers 43 and 44.

A length of the guide recess 45 may be greater than a diameter of the guide projection 28 so that the guide projection 28 of the valve plate 21 may be guided along the guide recess 45 of the valve arm 22. Thus, the linear movement of the valve arm 22 may be converted into the rotational movement of the valve plate 21.

As another example, the guide recess 45 may be an arc-shaped slot of which both ends are closed. The guide recess 45 may be formed in the first end portion 41 of the valve arm 22 or a portion of the valve arm 22 adjacent to the first end portion 41.

Figure 3:
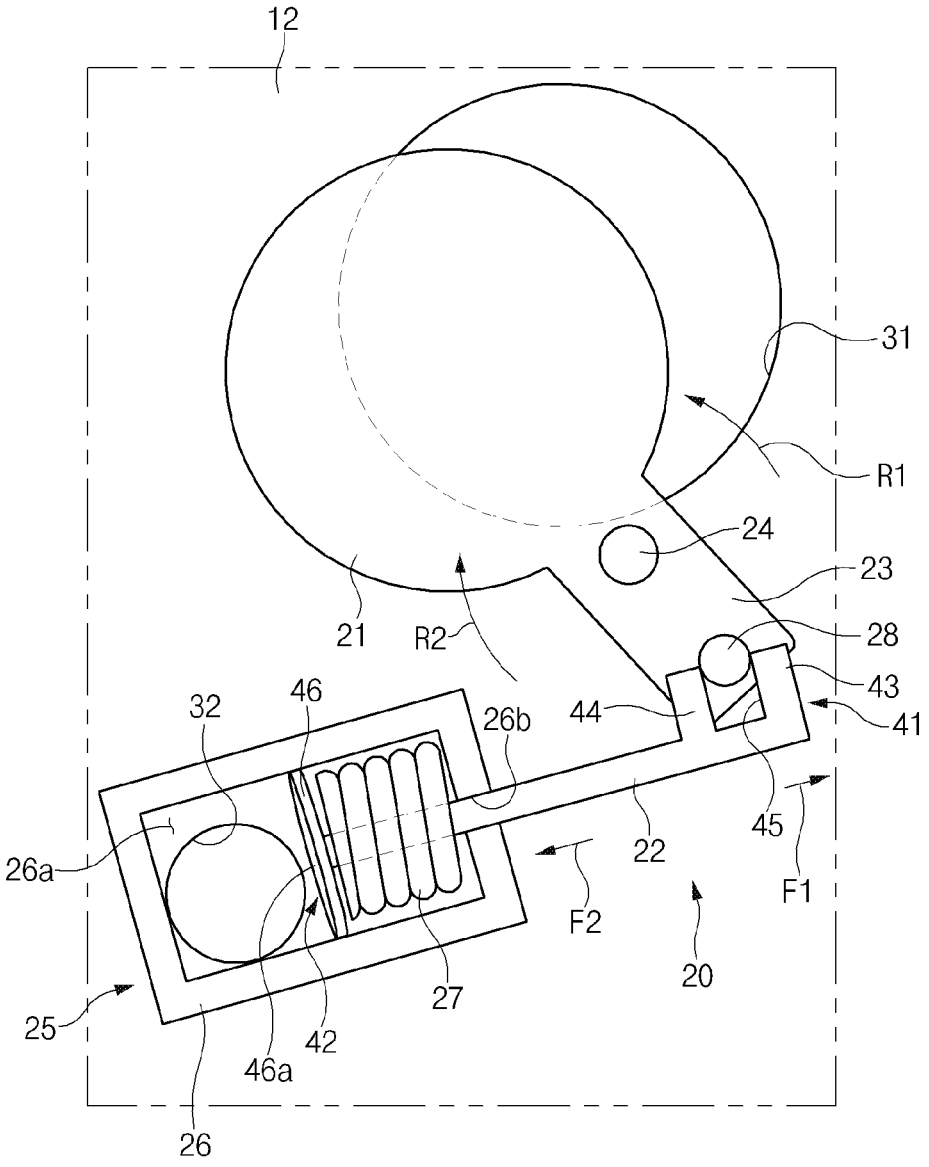
FIG. 3 illustrates a state in which a valve plate opens a first opening of a baffle, which is viewed from a direction indicated by arrow B of FIG. 2.
Figure 4:
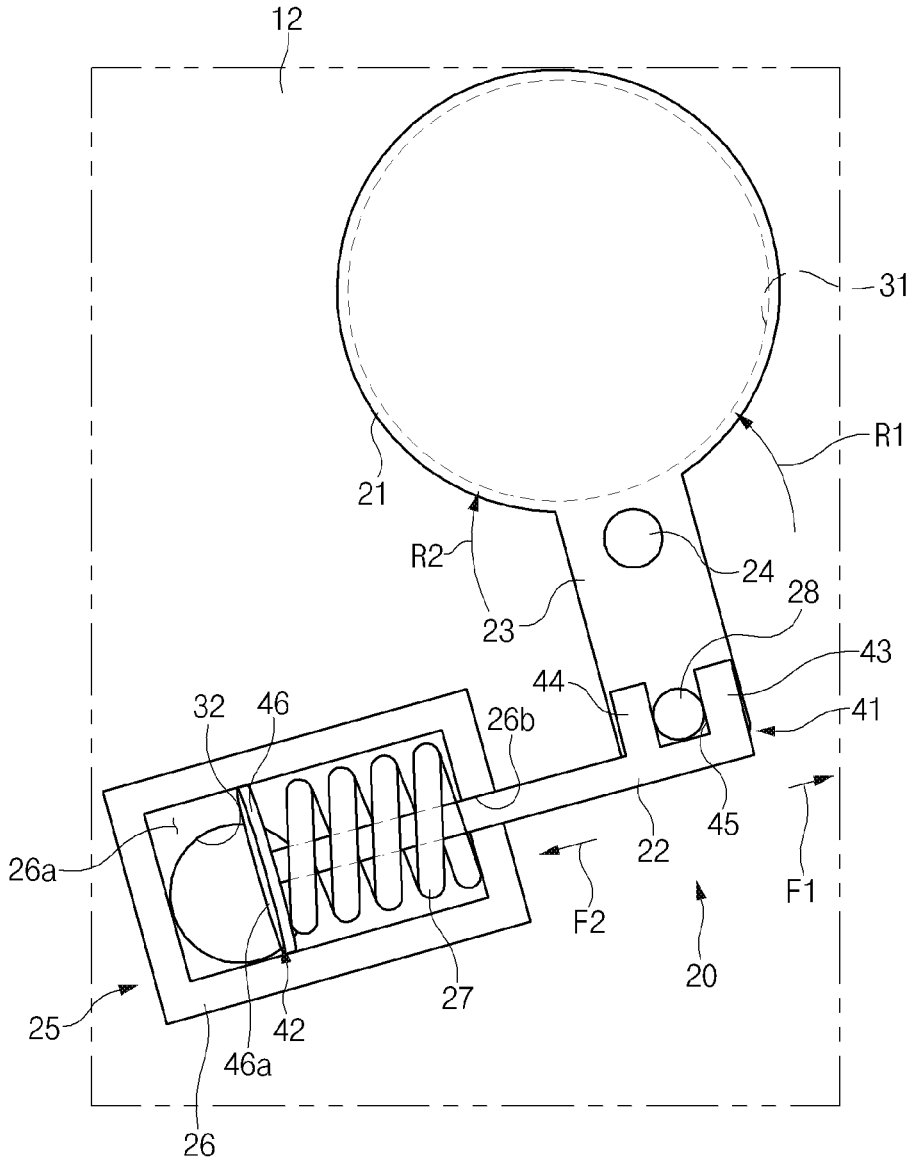
FIG. 4 illustrates a state in which a valve plate closes a first opening of a baffle.
Figure 5:
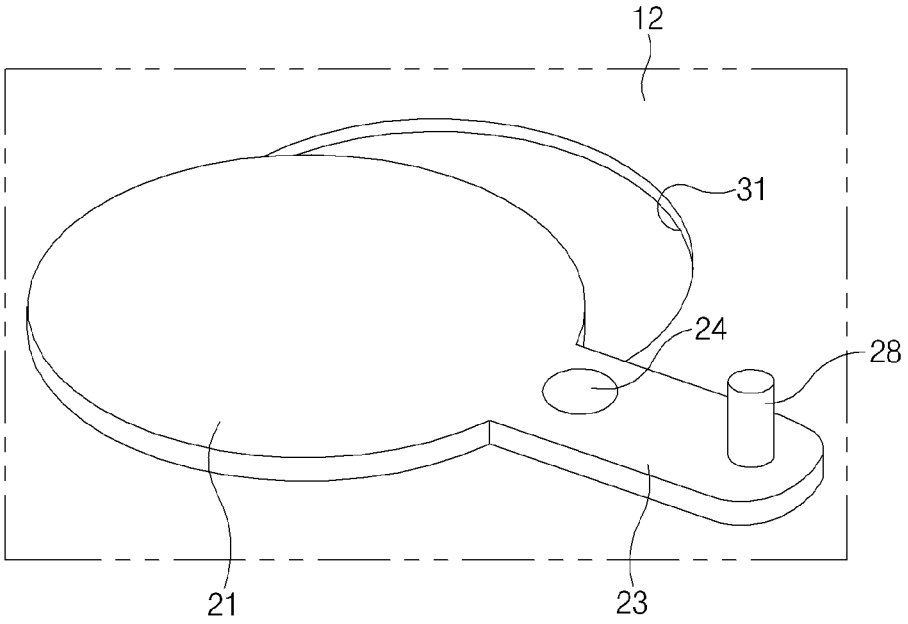
FIG. 5 illustrates a perspective view of a valve plate in a muffler for a vehicle according to an exemplary form of the present disclosure.
Figure 6:
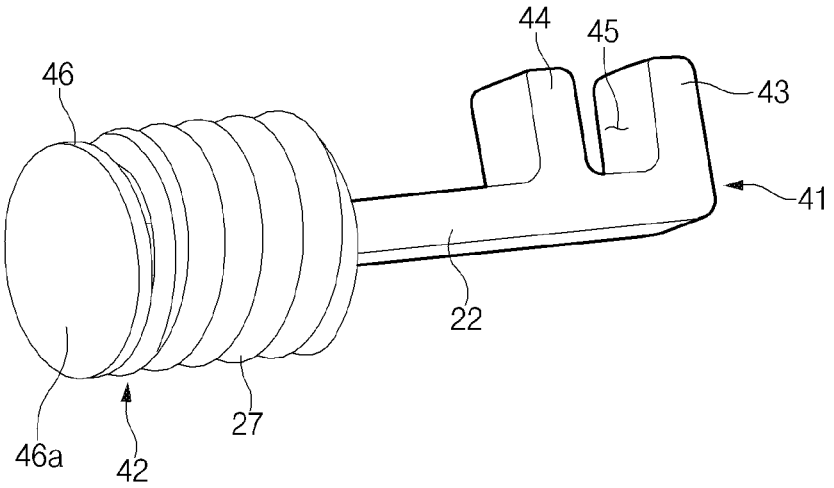
FIG. 6 illustrates a perspective view of a valve arm in a muffler for a vehicle according to an exemplary form of the present disclosure.

Referring to FIGS. 3, 4, and 6, the valve arm 22 may have a disc 46 attached to the second end portion 42, and the disc 46 may have a contact surface 46*a* with which the exhaust gas passing through the second opening 32 directly comes into contact. The disc 46 may have a predetermined area such as a circular section, and the contact surface 46*a* of the disc 46 may be perpendicular to the longitudinal axis of the valve arm 22, so that a contact area between the contact surface 46*a* of the disc 46 and the exhaust gas may be secured. Thus, the disc 46 may be sensitive to variations in the pressure of the exhaust gas, so that the pressure of the exhaust gas may be efficiently transmitted to the valve arm 22. The valve actuator 25 may drive the valve arm 22 and the valve plate 21 using the pressure of the exhaust gas.

According to an exemplary form, the valve actuator 25 may include an actuator housing 26 coupled to the baffle 12 to surround the second opening 32 of the baffle 12. The actuator housing 26 may have a space 26*a* receiving the exhaust gas which has passed through the second opening 32 of the baffle 12. The valve aim 22 may be moved linearly by variations in the pressure of the exhaust gas received in the space 26*a* of the actuator housing 26.

The actuator housing 26 may be coupled to the baffle 12 by welding and/or the like, and the receiving space 26*a* of the actuator housing 26 may directly communicate with the second opening 32 of the baffle 12. The disc 46 of the valve arm 22 may be located within the receiving space 26*a* of the actuator housing 26, and the contact surface 46*a* of the disc 46 may directly contact the exhaust gas which has passed through the second opening 32 of the baffle 12.

According to an exemplary form, the disc 46 may have a shape and a size conforming to the receiving space 26*a* of the actuator housing 26, so that the disc 46 and the valve aim 22 may be moved more easily by variations in the pressure of the exhaust gas received in the space 26*a*.

The actuator housing 26 may have a guide opening 26*b*, and the guide opening 26*b* of the actuator housing 26 may guide the movement of the valve arm 22. In particular, edges of the actuator housing 26 may be coupled to the baffle 12 by welding all around. Thus, the actuator housing 26 may be tightly sealed from the outside, except for the second opening 32 and the guide opening 26*b*.

The valve actuator 25 may include a spring 27 interposed between an inner surface of the actuator housing 26 and the disc 46. The spring 27 may be a coil spring disposed around the valve arm 22, and an axis of the spring 27 may be aligned with an axis of the valve arm 22. When the pressure of the exhaust gas is less than a spring force of the spring 27 (that is, the pressure of the exhaust gas is relatively low), the spring 27 may serve as a biasing element applying the spring force (biasing force) to bias the valve plate 21 toward a closed position.

Referring to FIG. 3, when the pressure of the exhaust gas received in the space 26*a* of the actuator housing 26 through the second opening 32 is greater than the spring force of the spring 27, the exhaust gas received in the space 26*a* of the actuator housing 26 may push the contact surface 46*a* of the disc 46 of the valve arm 22 to allow the valve arm 22 to move to the first direction F1. As the guide projection 28 of the valve plate 21 moves along the guide recess 45 of the valve arm 22, the valve plate 21 may rotate in the first rotation direction R1, and the valve plate 21 may open the first opening 31.

Referring to FIG. 4, when the pressure of the exhaust gas received in the space 26*a* of the actuator housing 26 through the second opening 32 is less than the elastic force of the spring 27, the elastic force of the spring 27 may overcome the pressure of the exhaust gas to allow the valve arm 22 to move to the second direction F2. As the guide projection 28 of the valve plate 21 moves along the guide recess 45 of the valve arm 22, the valve plate 21 may rotate in the second rotation direction R2, and the valve plate 21 may close the first opening 31.

As set forth above, according to exemplary forms of the present disclosure, the valve plate 21 may slidably rotate around the first opening 31 of the baffle 12 of the muffler 10, thereby opening and closing the first opening 31 of the baffle 12. Since the valve plate 21 and the baffle 12 are not spaced apart from each other, noise due to the shaking or vibrations of the valve plate itself, and noise due to an impact between the valve plate and the valve body may be prevented or minimized.

According to exemplary forms of the present disclosure, when the valve plate 21 opens and closes the first opening 31 of the baffle 12, the valve plate 21 may maintain the contact with the baffle 12, without the need of a shock absorbing material, and thus the weight and manufacturing cost may be reduced.

According to exemplary forms of the present disclosure, the spring 27 may be used as the biasing element which biases the valve plate 21 under the low pressure condition of the exhaust gas, and accordingly axial elasticity of the spring 27 may be used as a whole, so that driving stability and driving performance of the valve plate 21 may be secured. Meanwhile, according to the related art, a torsion spring may be used as the biasing element. On the other hand, according to exemplary forms of the present disclosure, the spring 27 may be used as the biasing element. Since the size of the spring is significantly reduced, the consumption of a material (for example, INCONEL) may be reduced, and thus the manufacturing cost and weight may be reduced.

Hereinabove, although the present disclosure has been described with reference to exemplary forms and the accompanying drawings, the present disclosure is not limited thereto, but may be variously modified and altered by those skilled in the art to which the present disclosure pertains without departing from the spirit and scope of the present disclosure.

What is claimed is:

1. A muffler for a vehicle, the muffler comprising:

a muffler shell;

a baffle disposed within the muffler shell, and having a first opening and a second opening, which allow an exhaust gas to pass therethrough; and a variable valve mounted on the baffle, wherein:

the variable valve includes:

a valve plate rotatably mounted to open and close the first opening of the baffle, a valve arm connected to the valve plate, and a valve actuator configured to move the valve arm by variations in pressure of the exhaust gas, the valve plate is configured to rotate in a plane parallel to a plane of the baffle, and the valve plate is rotatably mounted on the baffle through a shaft to maintain a contact with a surface of the baffle, and wherein:

the valve actuator includes an actuator housing having a receiving space which receives the exhaust gas through the second opening, the receiving space of the actuator housing directly communicates with the second opening of the baffle, edges of the actuator housing are coupled to the baffle by welding all around, the valve plate has a lug extending from an outer peripheral edge thereof, and the lug is rotatably mounted on the baffle through the shaft, the lug has a guide projection protruding in a direction away from the baffle, the valve arm has a guide recess by which a movement of the guide projection is guided, and as the valve arm moves, the guide projection of the lug is guided along the guide recess of the valve arm so that the valve plate rotates.

2. The muffler according to claim 1, wherein the valve arm is moved by the pressure of the exhaust gas received in the receiving space of the actuator housing.

3. The muffler according to claim 2, wherein the actuator housing has a guide opening by which a movement of the valve arm is guided.

4. The muffler according to claim 2, wherein the valve arm includes a disc located within the receiving space of the actuator housing, and the disc has a contact surface with which the exhaust gas received in the receiving space of the actuator housing directly comes into contact.

5. The muffler according to claim 4, wherein the disc has a shape and a size conforming to the receiving space of the actuator housing.

6. The muffler according to claim 4, wherein the contact surface of the disc is perpendicular to a longitudinal axis of the valve arm.

7. The muffler according to claim 4, wherein the valve actuator includes a spring interposed between an inner surface of the actuator housing and the disc.

* * * * *